US008480504B2

(12) United States Patent
Hilton et al.

(10) Patent No.: US 8,480,504 B2
(45) **Date of Patent: *Jul. 9, 2013**

(54) GOLF CLUB HEAD WITH ALIGNMENT MARKINGS

(75) Inventors: Thomas R. Hilton, Cardiff, CA (US); Augustin W. Rollinston, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 13/270,451

(22) Filed: Oct. 11, 2011

(65) Prior Publication Data

US 2012/0040771 A1 Feb. 16, 2012

Related U.S. Application Data

(63) Continuation-in-part of application No. 29/362,886, filed on Jun. 1, 2010, now Pat. No. Des. 623,710, and a continuation-in-part of application No. 29/367,280, filed on Aug. 5, 2010, now Pat. No. Des. 625,764, and a continuation-in-part of application No. 29/377,322, filed on Oct. 20, 2010, now Pat. No. Des. 641,814.

(60) Provisional application No. 61/391,938, filed on Oct. 11, 2010.

(51) Int. Cl.
*A63B 69/36* (2006.01)
*A63B 53/04* (2006.01)

(52) U.S. Cl.
USPC ..... 473/242; 473/252; 473/340

(58) Field of Classification Search
USPC ..... 473/251–254, 340–341; D21/736–746
See application file for complete search history.

(56) References Cited

U.S. PATENT DOCUMENTS

| | | | | | |
|---|---|---|---|---|---|
| 2,838,312 | A | * | 6/1958 | Drake | 473/332 |
| 2,859,972 | A | * | 11/1958 | Reach | 473/242 |
| 4,034,989 | A | * | 7/1977 | Stewart | 473/252 |
| 4,659,083 | A | * | 4/1987 | Szczepanski | 473/252 |
| 5,174,573 | A | | 12/1992 | Desbiolles | |
| 5,564,990 | A | | 10/1996 | Weeks | |
| 5,643,099 | A | | 7/1997 | Solheim | |
| 5,676,603 | A | * | 10/1997 | Miller | 473/220 |
| 5,839,970 | A | | 11/1998 | Lombardo | |
| 5,846,140 | A | | 12/1998 | Hoburg | |
| D405,137 | S | * | 2/1999 | Nelson | D21/738 |
| 5,921,868 | A | | 7/1999 | DiMartino | |
| 5,984,800 | A | * | 11/1999 | Uebelhor | 473/251 |
| D421,471 | S | | 3/2000 | Moldovan | |
| D429,785 | S | | 8/2000 | Leysock | |
| 6,203,445 | B1 | | 3/2001 | Rhodes | |
| D444,523 | S | | 7/2001 | Scribner | |
| 6,261,190 | B1 | | 7/2001 | Ashcraft | |
| 6,270,422 | B1 | | 8/2001 | Fisher | |
| 6,379,258 | B1 | | 4/2002 | To | |
| 6,394,910 | B1 | | 5/2002 | McCarthy | |

(Continued)

*Primary Examiner* — Sebastiano Passaniti
(74) *Attorney, Agent, or Firm* — Rebecca Hanovice; Michael A. Catania; Sonia Lari

(57) ABSTRACT

A golf club putter having an alignment pattern is disclosed herein. The alignment pattern has first and second long lines that approach each other as they extend from an aft region of the putter to a front region of the putter and, when the putter is properly aligned with a golf ball, create an optical illusion of convergence of said lines at or near a center of the golf ball without actually intersecting.

20 Claims, 6 Drawing Sheets

U.S. PATENT DOCUMENTS

| | | | | |
|---|---|---|---|---|
| D459,423 | S | 6/2002 | Long | |
| 6,558,268 | B2 | 5/2003 | Tindale | |
| 6,605,006 | B2 | 8/2003 | Mason | |
| 6,663,496 | B2 | 12/2003 | Cameron | |
| 6,692,378 | B2 | 2/2004 | Shmoldas | |
| 6,716,110 | B1 * | 4/2004 | Ballow | 473/242 |
| 6,743,112 | B2 | 6/2004 | Nelson | |
| 6,817,953 | B2 | 11/2004 | Farmer | |
| 6,837,799 | B2 | 1/2005 | Cameron | |
| 6,846,245 | B2 | 1/2005 | Baron | |
| D502,236 | S | 2/2005 | Grace | |
| D505,703 | S | 5/2005 | Fiskari | |
| 6,893,355 | B2 * | 5/2005 | Souza et al. | 473/251 |
| 6,951,518 | B2 * | 10/2005 | Solheim et al. | 473/324 |
| D511,195 | S | 11/2005 | Gouyet | |
| D511,801 | S | 11/2005 | Garcia | |
| D512,114 | S | 11/2005 | Garcia | |
| 6,960,140 | B2 | 11/2005 | Solheim | |
| 6,966,845 | B2 | 11/2005 | Solheim | |
| 6,984,181 | B2 * | 1/2006 | Hettinger et al. | 473/340 |
| 6,988,955 | B2 | 1/2006 | Stoakes | |
| D518,130 | S | 3/2006 | Grace | |
| 7,014,566 | B1 | 3/2006 | Norvise | |
| 7,014,567 | B2 | 3/2006 | Wang | |
| D519,592 | S | 4/2006 | Gammon | |
| 7,022,030 | B2 | 4/2006 | Best | |
| 7,052,409 | B2 | 5/2006 | Goldsmith | |
| 7,052,411 | B2 | 5/2006 | Solheim | |
| 7,066,829 | B1 | 6/2006 | Lister | |
| 7,077,757 | B1 | 7/2006 | Payne | |
| D526,035 | S | 8/2006 | Hueber | |
| 7,083,524 | B2 | 8/2006 | Daniels | |
| 7,086,957 | B2 | 8/2006 | Solheim | |
| 7,144,335 | B2 * | 12/2006 | Breier et al. | 473/340 |
| RE39,472 | E | 1/2007 | Ahn | |
| 7,169,061 | B2 | 1/2007 | Hou | |
| 7,182,697 | B2 | 2/2007 | Zamora | |
| D542,869 | S | 5/2007 | Adams | |
| 7,223,178 | B2 | 5/2007 | Henry | |
| 7,235,021 | B2 | 6/2007 | Solheim | |
| 7,255,650 | B2 | 8/2007 | Bryant | |
| D552,196 | S | 10/2007 | Hueber | |
| 7,309,291 | B1 | 12/2007 | Bryant | |
| 7,326,121 | B2 | 2/2008 | Roake | |
| 7,335,112 | B1 | 2/2008 | Bitondo | |
| D565,685 | S | 4/2008 | Homma | |
| D565,686 | S | 4/2008 | Homma | |
| 7,351,162 | B2 | 4/2008 | Soracco | |
| 7,371,184 | B2 | 5/2008 | Tao | |
| 7,371,185 | B1 | 5/2008 | Rohrer | |
| 7,377,858 | B2 | 5/2008 | Kubota | |
| 7,393,285 | B2 | 7/2008 | Stellander | |
| 7,399,233 | B2 | 7/2008 | Pollman | |
| D574,456 | S | 8/2008 | Chen et al. | |
| D580,505 | S | 11/2008 | Solheim | |
| 7,448,955 | B2 | 11/2008 | Bryant | |
| D583,889 | S | 12/2008 | Stites | |
| D587,328 | S | 2/2009 | Sano | |
| 7,491,131 | B2 | 2/2009 | Vinton | |
| D588,658 | S | 3/2009 | de la Cruz | |
| 7,510,481 | B2 | 3/2009 | Sevon | |
| D616,053 | S | 5/2010 | Chien et al. | |
| 7,766,762 | B2 | 8/2010 | Stellander | |
| D623,710 | S * | 9/2010 | Hilton et al. | D21/743 |
| 7,803,066 | B2 | 9/2010 | Solheim et al. | |
| D625,764 | S * | 10/2010 | Hilton et al. | D21/743 |
| 7,918,745 | B2 | 4/2011 | Morris et al. | |
| 7,955,180 | B2 | 6/2011 | Bittner | |
| D641,814 | S * | 7/2011 | Hilton et al. | D21/742 |
| 7,993,217 | B2 | 8/2011 | Cameron | |
| 8,075,416 | B2 | 12/2011 | Stites | |
| 8,100,779 | B2 | 1/2012 | Solheim et al. | |
| 8,109,838 | B2 | 2/2012 | Solheim et al. | |
| 8,246,481 | B2 * | 8/2012 | Stites et al. | 473/254 |
| 2005/0075185 | A1 * | 4/2005 | Green | 473/240 |
| 2005/0187028 | A1 * | 8/2005 | Chang et al. | 473/231 |
| 2005/0192114 | A1 * | 9/2005 | Zider et al. | 473/251 |
| 2006/0063601 | A1 | 3/2006 | Cameron | |
| 2008/0176672 | A1 | 7/2008 | Roach | |
| 2009/0017933 | A1 | 1/2009 | Stites | |
| 2009/0017934 | A1 | 1/2009 | Stites | |
| 2010/0167831 | A1 | 7/2010 | Smith et al. | |
| 2010/0173720 | A1 | 7/2010 | Kim | |
| 2010/0304878 | A1 | 12/2010 | Reichow et al. | |
| 2010/0323807 | A1 | 12/2010 | Rha | |
| 2011/0034262 | A1 | 2/2011 | Takechi et al. | |
| 2011/0190070 | A1 | 8/2011 | Morris et al. | |
| 2012/0094782 | A1 | 4/2012 | Beach et al. | |
| 2012/0115627 | A1 | 5/2012 | Pohl | |

* cited by examiner

GOLF CLUB HEAD WITH ALIGNMENT MARKINGS

CROSS REFERENCES TO RELATED APPLICATIONS

The present application claims priority to, and is a continuation in part of, U.S. Design Pat. application No. 29/362,886, filed on Jun. 1, 2010, and issued as U.S. Design Pat. No. D623,710 on Sep. 14, 2010, the disclosure of which is incorporated in its entirety herein. The present application also claims priority to, and is a continuation in part of, U.S. Design Pat. application No. 29/367,280, filed on Aug. 5, 2010, and issued as U.S. Design Pat. No. D625,764 on Oct. 19, 2010, the disclosure of which is incorporated in its entirety herein. The present application also claims priority to, and is a continuation in part of, U.S. Design Pat. application No. 29/377,322, filed on Oct. 20, 2010, and issued as U.S. Design Pat. No. D641,814 on Jul. 19, 2011. The present application also claims priority to U.S. Provisional Application No. 61/391,938, filed on Oct. 11, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a putter type golf club head. The present invention more specifically relates to a putter-type golf club head having alignment markings on its top surface to help a golfer line up the golf club head with a golf ball.

2. Description of the Related Art

The golf industry routinely develops putters that are intended make the game of golf easier for the high handicap player. One such putter is disclosed in U.S. Pat. No. 4,688,798 to David Pelz, which discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter. The large number of converging lines taught by Szczepanski can be distracting to a golfer, however.

A further patent that discloses an alignment means is U.S. Pat. No. 7,371,184 to Tao. The Tao patent also discloses a group of lines that converge at the center of the face of a putter.

Although these inventions have provided putters for making the game of golf more enjoyable for high handicap players, the prior art has not optimized a putter alignment feature for high handicap players.

BRIEF SUMMARY OF THE INVENTION

One aspect of the present invention is an alignment pattern for a putter head comprising a first long line and a second long line, wherein the first and second long lines extend from a rear portion of the putter head to a face of the putter head, and wherein the first and second long lines converge without intersecting as they approach the face. The first and second long lines may be between 2 and 4 inches long, may originate at the rear portion at a distance of between 1 and 2 inches from each other, and may terminate at the face at a distance of less than an inch from each other.

In a further embodiment, the first and second long lines create an optical illusion of continuity past the face and into a golf ball when the golf ball is properly aligned with the putter head. In yet a further embodiment, the first and second long lines create an optical illusion whereby the first and second long lines appear to intersect at a center of the golf ball when the golf ball is properly aligned with the putter head. In another embodiment, the putter head further comprises median stripe disposed between the first and second long lines. In one embodiment, the first and second long lines do not intersect with the median stripe. In another embodiment, the alignment feature may further comprise first and second short lines.

Another aspect of the present invention is a putter head comprising a top surface, a face, and a rear end, wherein the top surface has a front region proximate the face and an aft region proximate the rear end, wherein the top surface comprises an alignment feature having a first long line and a second long line, wherein the first long line and second long line extend from the aft region to the front region, and wherein the first long line and second long line converge without intersecting. The first and second long lines may be between 2 and 4 inches long, may originate at the aft region at a distance of between 1 and 2 inches from each other, and may terminate at the front region at a distance of less than an inch from each other.

In a further embodiment of the present invention, the first and second long lines create an optical illusion of continuity past the face and into a golf ball when the golf ball is properly aligned with the putter head. In another embodiment, the first and second long lines create an optical illusion whereby the first and second long lines appear to intersect at a center of the golf ball when the golf ball is properly aligned with the putter head. In yet another embodiment, the alignment feature of the putter head further comprises a median stripe disposed between the first and second long lines. In one embodiment of the present invention, the first and second long lines do not intersect the median stripe. In yet another embodiment of the present invention, the alignment feature further comprises first and second short lines.

In a further embodiment of the present invention, the putter head is composed of a metal selected from the group consisting of stainless steel, aluminum, aluminum alloy, titanium, titanium alloy, magnesium, magnesium alloy, tungsten, and tungsten alloy. In another embodiment, the putter head is composed of stainless steel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
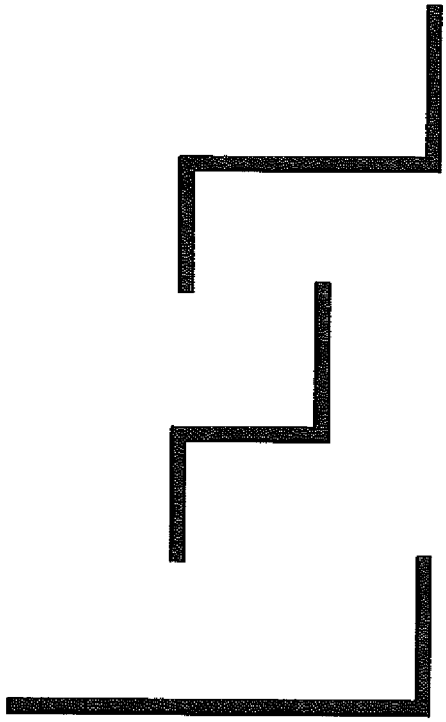
FIG. 1 is an example of an optical illusion.

As shown in FIGS. 3A, 3B, 5A, 5B, 7A, and 7B, a putter-type club head of the present invention is generally designated 20. The club head 20 includes a top surface 25 which has an opening or hosel 30 to receive the end of a shaft 40. The club head 20 also includes a face portion 50, a sole 55, and an aft region 60. The top surface 25 of the invention includes an alignment feature 70 to help a golfer line up the putter head 20 with a golf ball 100. The putter head 20 of the present invention preferably is used with a golf ball 100 (shown in FIGS. 4A, 4B, 6A, and 6B) having a diameter of approximately 1.680 inches, but the putter head 20 may also be used with golf balls having different sizes.

Figure 2:
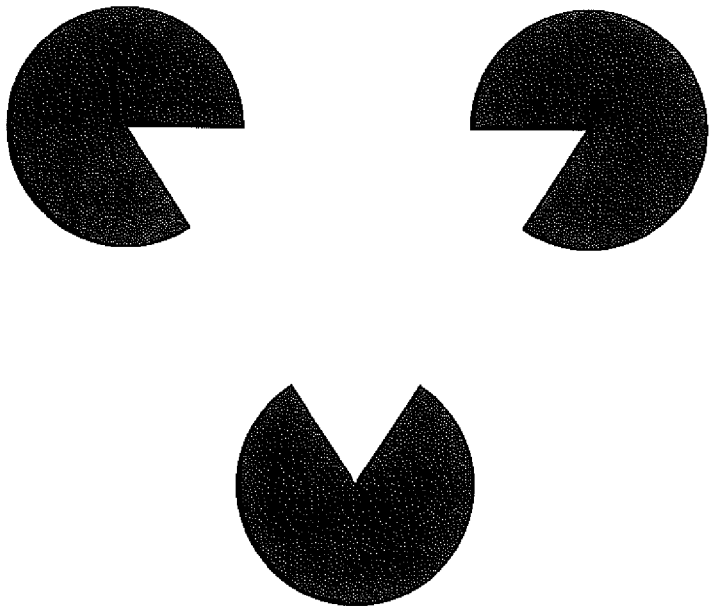
FIG. 2 is another example of an optical illusion.

The alignment feature of the present invention 70 creates an optical illusion that assists a golfer with aligning the putter head 20 with a golf ball 100. According to Wikipedia, an optical illusion "is characterized by visually perceived images that differ from objective reality." One type of optical illusion is a shape or combination of shapes that create the appearance of an image that is not actually there. FIGS. 1 and 2 are examples of such an optical illusion. FIG. 1 shows three bent lines which suggest the shape of an uppercase "E." FIG. 2 is a reproduction of the Kanizsa Triangle, which suggests a bright white triangle.

Figure 3A:
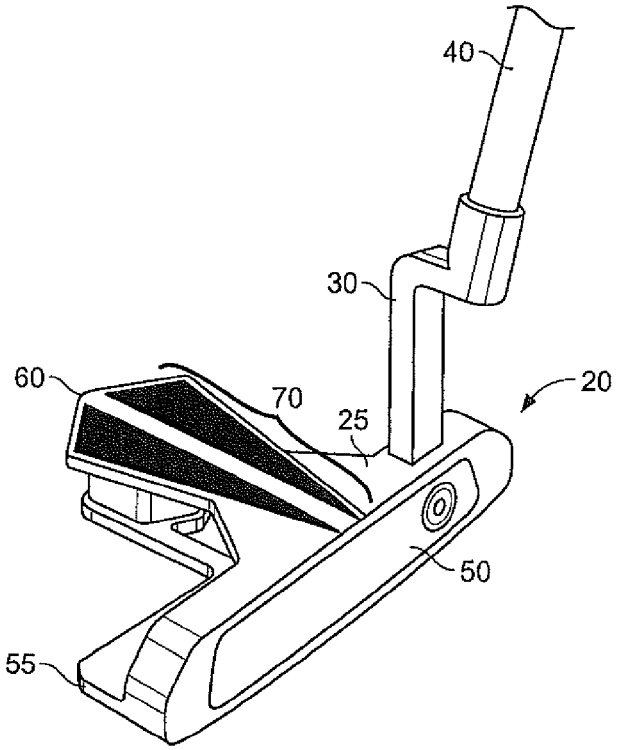
FIG. 3A is a perspective view of a golf club head according to one embodiment of the present invention.
Figure 3B:
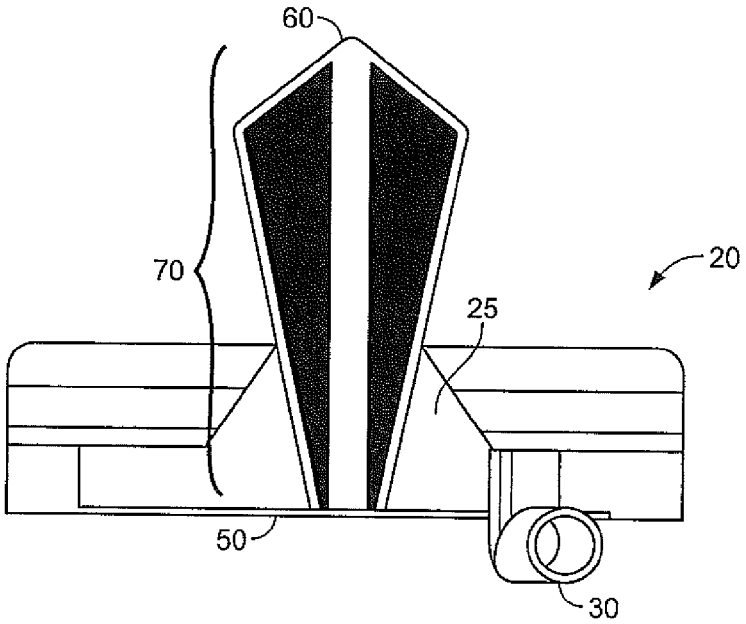
FIG. 3B is a plan view of the golf club head shown in FIG. 3A.
Figure 4A:
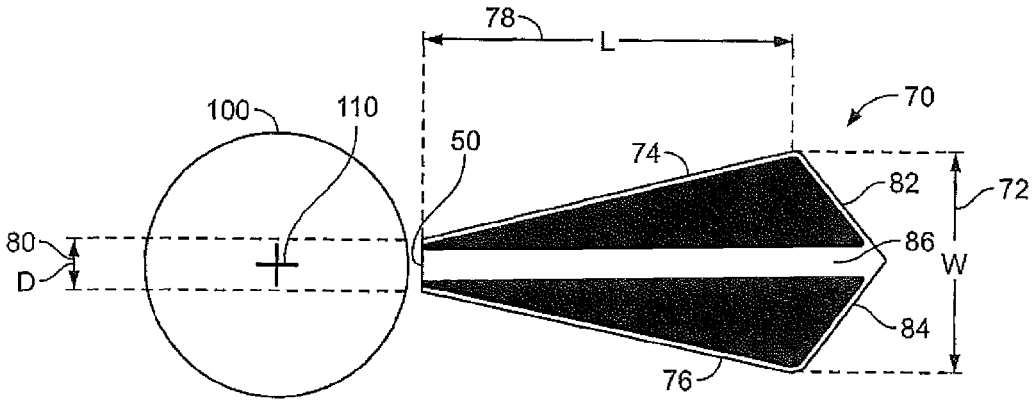
FIG. 4A is a diagram of the alignment feature of the present invention as applied to the golf club head shown in FIGS. 3A and 3B.
Figure 4B:
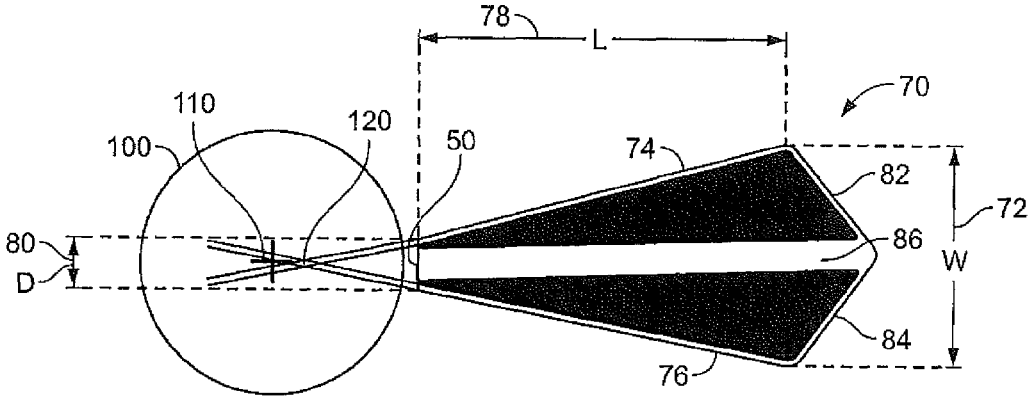
FIG. 4B is another diagram of the alignment feature shown in FIG. 4A.

FIGS. 3A and 3B show a preferred embodiment of the putter head 20 of the present invention. The shape of this putter head 20 is known as a "blade." FIGS. 4A and 4B show the alignment feature 70 of the preferred embodiment of the present invention. As shown in FIGS. 4A and 4B, the alignment feature 70 creates an optical illusion of continuity past the center of the face portion 50 of the putter head 20. The alignment feature 70 preferably has a maximum width W 72 of between 1.00 and 2.00 inches, more preferably between 1.25 and 1.75 inches, and most preferably 1.394 inches. The alignment feature 70 preferably has two long lines 74, 76, each of which has a length L 78 that preferably is between 2 and 3 inches, more preferably between 2.25 and 2.75 inches, and most preferably 2.360 inches. The alignment feature 70 also preferably has two shorter lines 82, 84. The maximum width 72 is the distance between the long lines 74, 76 when they are spaced furthest from each other. The length, width, and distance between the lines are important because they capture the golfer's attention and draw the golfer's eye along the top of the putter head 20 towards the face 50.

As shown in FIGS. 4A and 4B, the long lines 74, 76 of the alignment feature 70 converge as they approach the face portion 50, but do not intersect on the top surface 25 of the putter head 20. Instead, they reach the face 50 at a distance D 80 from one another that is preferably between 0.25 and 1 inch, more preferably between 0.3 and 0.4 inch, and most preferably 0.337 inch. The distance 80 also represents the minimum width of the alignment feature. A median stripe 86 having a width that is smaller than that of the distance 80 bisects the alignment feature 70 and is aligned with the center of the face 50. The distance 80 measurement is important because it helps define the optical illusion of continuity past the face 50.

The alignment feature 70 creates an optical illusion, illustrated in FIG. 4B, that long lines 74, 76 extend into the golf ball 100 and intersect at or near the center 110 of the golf ball 100 when the golf ball 100 is properly aligned with the putter head 20. The optical illusion created by the alignment feature 70 thus indicates to the golfer when the golf ball 100 is lined up at the center of the face portion 50. In the preferred embodiment, the hypothetical intersection point 120 is located between the center 110 of the golf ball 100 and the center of the face portion 50. The median stripe 86 also can assist a golfer with aligning the golf ball 100.

Figure 5A:
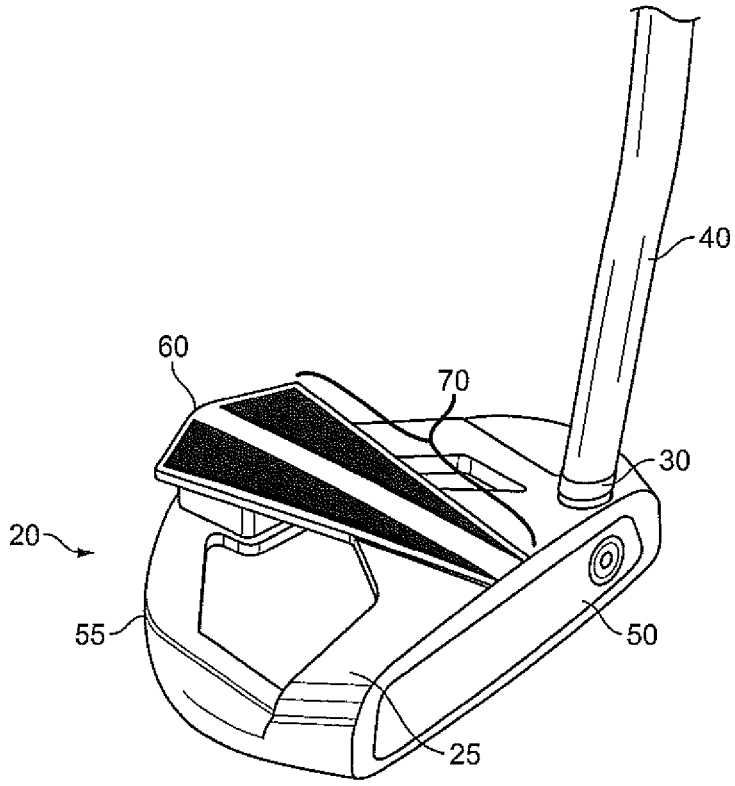
FIG. 5A is a perspective view of a golf club head according to a second embodiment of the present invention.
Figure 5B:
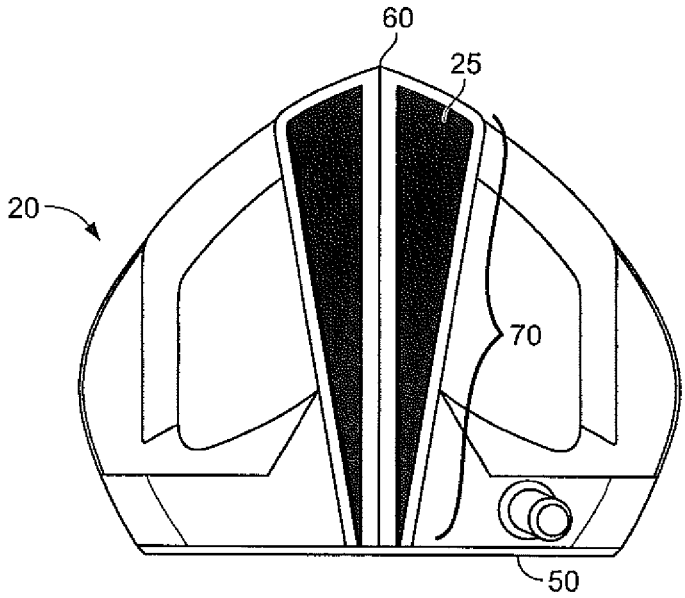
FIG. 5B is a plan view of the golf club head shown in FIG. 5A.
Figure 6A:
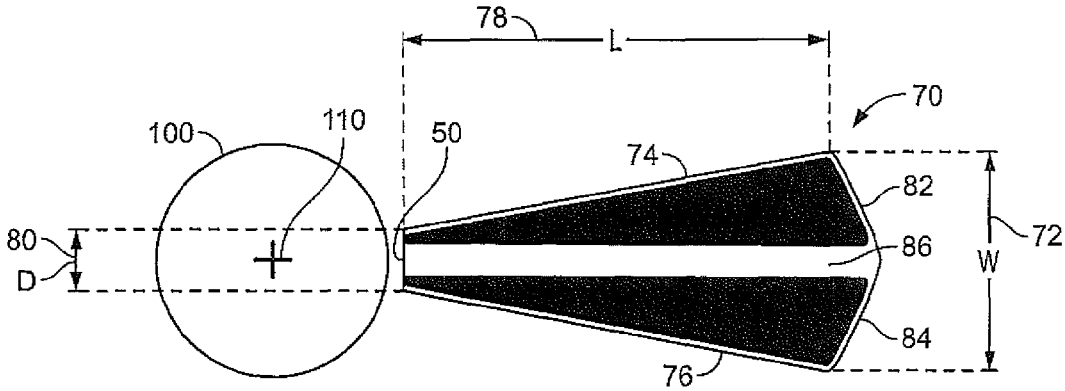
FIG. 6A is a diagram of the alignment feature of the present invention as applied to the golf club head shown in FIGS. 5A and 5B.
Figure 6B:
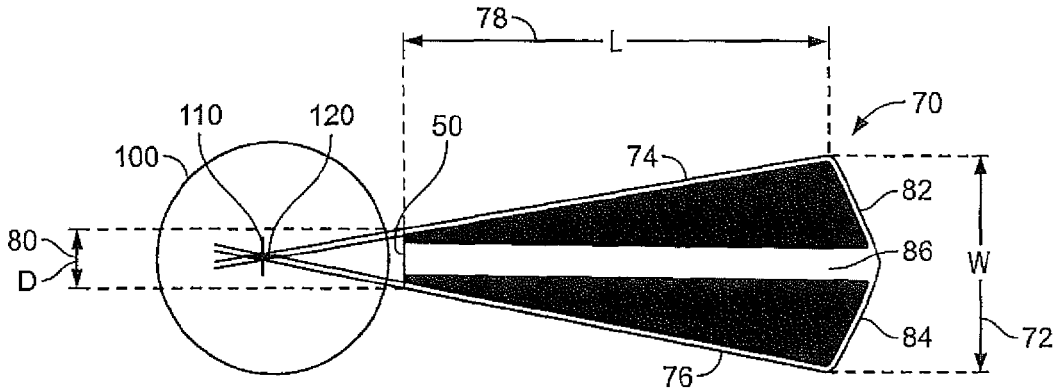
FIG. 6B is another diagram of the alignment feature shown in FIG. 6A
Figure 7A:
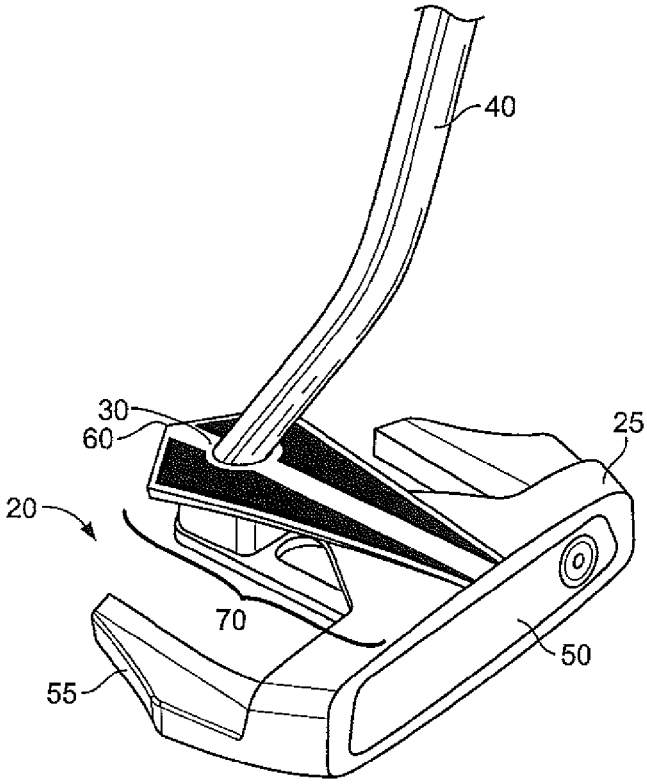
FIG. 7A is a perspective view of a golf club head according to a third embodiment of the present invention.
Figure 7B:
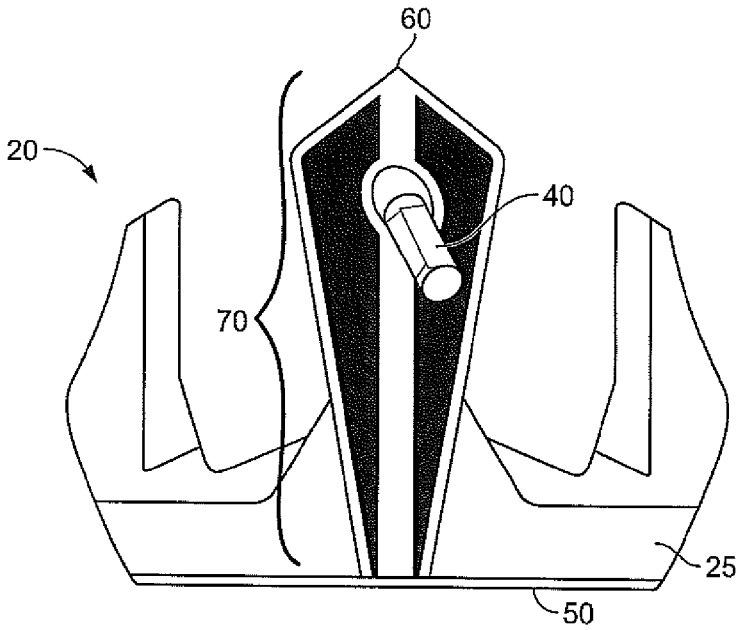
FIG. 7B is a plan view of the golf club head shown in FIG. 7A.

FIGS. 5A and 5B show an alternative embodiment of the putter head 20 of the present invention. The shape of this putter head 20 is known as a "mallet." FIGS. 6A and 6B show the alignment feature 70 of this putter head 20. As shown in FIGS. 6A and 6B, the alignment feature 70 is similar to the alignment feature 70 shown in FIGS. 4A and 4B. The alignment feature 70 creates an optical illusion of continuity past the center of the face portion 50 of the putter head 20. The alignment feature 70 of this embodiment preferably has a maximum width W 72 of between 1.00 and 2.00 inches, more preferably between 1.25 and 1.75 inches, and most preferably 1.558 inches. The alignment feature 70 preferably has two long lines 74, 76, each of which has a length L 78 that preferably is between 2 and 4 inches, more preferably between 2.50 and 3.50 inches, and most preferably 3.061 inches. The alignment feature 70 also preferably has two shorter lines 82, 84. The maximum width 72 is the distance between the long lines 74, 76 when they are spaced furthest from each other. As discussed herein, the length, width, and distance between the lines are important because they capture the golfer's attention and draw the golfer's eye along the top of the putter head 20 towards the face 50.

As shown in FIGS. 6A and 6B, the long lines 74, 76 of the alignment feature converge as they approach the face portion 50, but do not intersect on the top surface 25 of the putter head 20. Instead, they reach the face 50 at a distance D 80 from one another that is preferably between 0.25 and 1 inch, more preferably between 0.3 and 0.5 inch, and most preferably 0.425 inch. The distance 80 also represents the minimum width of the alignment feature. A median stripe 86 having a width that is smaller than that of the distance D 80 bisects the alignment feature 70 and is aligned with the center of the face 50. The distance 80 measurement is important because it helps define the optical illusion of continuity past the face 50.

The alignment feature 70 creates the optical illusion, illustrated in FIG. 6B, that long lines 74, 76 extend into the golf ball 100 and intersect at or near the center 110 of the golf ball 100 when the golf ball is properly aligned with the putter head 20. The optical illusion created by the alignment feature 70 thus indicates to the golfer when the golf ball 100 is lined up at the center of the face portion 50. In this embodiment, the hypothetical intersection point 120 is located at the center 110 of the golf ball 100 and is directly in front of the center of the face portion 50. The median stripe 86 also can assist a golfer with aligning the golf ball 100.

Referring to FIGS. 4A, 4B, 6A, and 6B in an alternative embodiment, distance L 78 refers to the length of the top surface 25 spanned by the long lines 74, 76, not the length of the long lines 74, 76 themselves. In other words, in an alternative embodiment of the mallet design shown in FIGS. 5A and 5B, long lines 74, 76 preferably extend over approximately 3.061 inches of the top surface 25. In other alternative embodiments, the long lines 74, 76 may extend over between 2 and 4 inches of the top surface 25. In these alternative embodiments, the long lines 74, 76 are themselves longer than distance L 78 because they extend diagonally across the top surface 25.

In the preferred embodiment, the club head 20 is composed of a material having a density ranging from 1 g/cm to 10.0 g/cm. A preferred metal for the club head 20 is stainless steel. Alternative materials for the club head 20 include aluminum, aluminum alloys, titanium, titanium alloys, magnesium, magnesium alloys, tungsten, tungsten alloys, and the like. The club head 20 is preferably formed as a single cast structure using known investment casting techniques. In other embodiments, the face portion 50, top surface 25, sole 55, and hosel 30 may be made from cast or forged metals or from composite materials, and may be formed integrally or pieced together. In yet other embodiments, the face portion 50, top surface 25, sole 55, and hosel 30 each may be composed of different materials. Those skilled in the pertinent art will recognize that alternative forming techniques such as milling, welding forged or found pieces, and the like may be utilized without departing from the scope and spirit of the present invention.

The putter-type club head 20 of the present invention preferably has a mass ranging from 250 grams to 500 grams, more preferably from 300 grams to 400 grams, and most preferably 360 grams.

The face portion 50 preferably has a thickness ranging from 0.10 inch to 0.50 inch, more preferably 0.20 inch to 0.35 inch. Preferably, an external surface of the face preferably has a face recess, not shown, therein with a face insert disposed therein such as disclosed in U.S. Pat. No. 6,238,302, entitled A Golf Club Head with an Insert Having Integral Tabs, assigned to Callaway Golf (the assignee of the Present Application), which is hereby incorporated by reference in its entirety. As disclosed in U.S. Pat. No. 6,238,302, the face insert is preferably composed of a thermosetting polyurethane material and is preferably colored white.

The putter-type club head 20 preferably has a length from the face portion 50 to the rearward most end of the aft region 60, preferably ranging from 2.0 inches to 6.0 inches, more preferably from 3 inches to 4 inches, and most preferably 3.5 inches.

The putter-type club head 20 preferably has a moment of inertia about the Izz axis through the center of gravity ranging from 3750 g-cm$^2$ to 4200-cm$^2$, and more preferably 3950 g-cm$^2$ to 4100 g-cm$^2$. The Izz axis is vertical and extends from the sole to the top surface.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An alignment pattern for a top surface of a putter head comprising:

a first long line having a length of 2 to 4 inches; and and a second long line having a length of 2 to 4 inches, wherein the first and second long lines extend from a rear portion of the top surface of the putter to a location proximate a face of the putter, wherein the first and second long lines converge without intersecting as they approach the face, wherein the first and second long lines create an optical illusion of continuity past the face and into a golf ball having a diameter of approximately 1.680 inches when the golf ball is properly aligned with the putter head and is substantially adjacent to the face, and wherein the first and second long lines appear to intersect at a center of the golf ball.

2. The alignment pattern of claim 1, further comprising a median stripe disposed between the first and second long lines.

3. The alignment pattern of claim 2, wherein the median stripe extends from a rearward-most end of the top surface of the putter to a location proximate the face of the putter.

4. The alignment pattern of claim 2, wherein the median stripe has a length that is less than the lengths of the first and second long lines.

5. The alignment pattern of claim 2, wherein the median stripe bisects the alignment pattern.

6. The alignment pattern of claim 2, wherein the first and second long lines do not intersect the median stripe.

7. The alignment pattern of claim 1, wherein the first and second long lines originate at the rear portion at a distance of between 1 and 2 inches from each other.

8. The alignment pattern of claim 1, wherein the first and second long lines terminate at the face at a distance of less than an inch from each other.

9. The alignment pattern of claim 1, further comprising first and second short lines.

10. A putter head comprising a top surface, a face, and a rear end, wherein the putter head has a mass of 250 to 500 grams, wherein the top surface has a front region proximate the face and an aft region proximate the rear end, wherein the top surface comprises an alignment feature having a first long line and a second long line, wherein the first long line and second long line extend from the aft region to the front region, wherein the first long line and second long line converge without intersecting, wherein the first and second long lines are between 2 and 4 inches long, wherein the first and second long lines create an optical illusion of continuity past the face and into a golf ball having a diameter of approximately 1.68 inches when the golf ball is properly aligned with the putter head and is substantially adjacent to the face, and wherein the first and second long lines appear to intersect at a center of the golf ball.

11. The putter head of claim 10, wherein the putter head is composed of a metal selected from the group consisting of stainless steel, aluminum, aluminum alloy, titanium, titanium alloy, magnesium, magnesium alloy, tungsten, and tungsten alloy.

12. The putter head of claim 11, wherein the putter head is composed of stainless steel.

13. The putter head of claim 10, wherein the alignment feature further comprises a median stripe disposed between the first and second long lines.

14. The putter head of claim 13, wherein the first and second long lines do not intersect the median stripe.

15. The putter head of claim 13, wherein the median stripe extends from the aft region to the front region, and wherein the median stripe has a length that is less than the lengths of the first and second long lines.

16. The putter head of claim 10, wherein the first and second long lines originate at the aft region at a distance of between 1 and 2 inches from each other.

17. The putter head of claim 10, wherein the first and second long lines terminate at the front region at a distance of less than an inch from each other.

18. The putter head of claim 10, wherein the alignment feature further comprises first and second short lines.

19. The putter head of claim 10, further comprising a face insert composed of a polyurethane material.

20. The putter head of claim 10, wherein the face has a thickness of 0.10 to 0.50 inch.

* * * * *